US006374433B1

(12) United States Patent
Gray

(10) Patent No.: US 6,374,433 B1
(45) Date of Patent: Apr. 23, 2002

(54) MOVEABLE HOT TUB COVER STRUCTURE

(76) Inventor: Daniel Gray, 814 Wood Ave., Carter Lake, IA (US) 51510

( * ) Notice: Subject to any disclaimer, the term of this patent is extended or adjusted under 35 U.S.C. 154(b) by 0 days.

(21) Appl. No.: 09/818,395

(22) Filed: Mar. 27, 2001

(51) Int. Cl.[7] ..... E04H 4/08

(52) U.S. Cl. ..... 4/498; 4/499; 4/500; 4/502; 52/3

(58) Field of Search ..... 4/498, 499, 500, 4/502, 580; 52/3

(56) References Cited

U.S. PATENT DOCUMENTS

| | | | | | |
|---|---|---|---|---|---|
| 3,093,834 | A | * | 6/1963 | Watkins | 4/500 X |
| 3,469,587 | A | * | 9/1969 | Folkes | 4/498 X |
| 4,175,361 | A | * | 11/1979 | Kumode | 52/66 |
| 4,246,663 | A | * | 1/1981 | Aragona et al. | 4/500 |
| 4,783,861 | A | * | 11/1988 | Leurent | 4/498 |

FOREIGN PATENT DOCUMENTS

| | | | | |
|---|---|---|---|---|
| EP | 172770 | * | 2/1986 | 4/498 |
| FR | 2690476 | * | 10/1993 | 52/64 |

* cited by examiner

*Primary Examiner*—Gregory L. Huson
*Assistant Examiner*—Kathleen J. Prunner
(74) *Attorney, Agent, or Firm*—Adam H. Jacobs

(57) ABSTRACT

A moveable hot tub cover structure removably covers a hot tub and includes at least one rail structure mounted generally adjacent the hot tub and extending outwards therefrom and a rigid hot tub cover structure including at least two upright walls having bases and upper sections and a roof extending between and connecting the at least two upright walls adjacent upper sections thereof such that the roof is spaced from the bases of the upright walls to permit the rigid hot tub cover structure to enclose the hot tub and be used with the rigid hot tub cover structure thereon. At least two rail-engaging wheels are mounted on the rigid hot tub cover structure. The wheels are operative to rollably engage the rail structure. A drive device, such as a garage door opener-type chain drive, is operatively connected to the hot tub cover structure for rollably moving the rigid hot tub cover structure on the rail structure between a hot tub covering position over and above the hot tub and a hot tub open position adjacent to and not covering the hot tub whereby the hot tub is useable in both the hot tub covering and open positions.

8 Claims, 6 Drawing Sheets

MOVEABLE HOT TUB COVER STRUCTURE

BACKGROUND OF THE INVENTION

1. Technical Field

The present invention relates to cover structures for hot tubs, and more particularly, to a moveable hot tub structure for moveably covering a hot tub which includes at least one rail structure mounted adjacent the hot tub, a hot tub structure, including at least two upright walls and a roof extending between the walls adjacent the upper sections thereof, at least two rail-engaging wheels mounted on the hot tub cover structure which rollably engage the rail structure and a drive device such as a garage door opener-type chain drive for rollably moving the hot tub structure between a hot tub cover position over and above the hot tub and the hot tub open position adjacent the hot tub so that the hot tub may be used with the hot tub cover structure either over the hot tub or with the hot tub open.

2. Description of the Prior Art

The popularity of hot tubs is ever-increasing, with users of all ages and from all parts of the world purchasing and using hot tubs for therapeutic and recreational purposes. Due to the size of most hot tubs, however, it is necessary to build the hot tub in an outdoor location adjacent the residents of the person purchasing the hot tub. While this does not limit the use of the hot tub in tropical or sub-tropical regions, it should be clear that in temperate regions and regions colder than temperate regions the length of time which the hot tub can be used is limited by the advance of cold weather. Although many individuals do use hot tubs during cold weather, getting out and drying off after the hot tub experience is not nearly as enjoyable as the hot tub experience itself. Many hot tub owners have thus taken to constructing or adding a cover structure such as a gazebo over the hot tub to increase the useable time span of the hot tub during the calendar year.

It should be noted, however, that the gazebos which are constructed over the hot tubs thus become permanent additions to the hot tub structure and the hot tub cannot be used without the gazebo in place. While this is fine during periods of cold weather, the enjoyment of the hot tub during hot weather is greatly reduced due to the gazebo structure in place over the hot tub, which restricts the hot tub user's access to the surrounding environment. There is therefore a need for a removable hot tub cover structure which can be moved from a covering position which protects the immediate vicinity of the hot tub from the surrounding environment to an open position which exposes the hot tub to the surrounding environment, thus permitting the user of the hot tub to experience the surrounding environment.

There are numerous examples found in the prior art of cover structures which are designed to be removed and replaced on the hot tub to prevent the release of heat from the hot tub. These include such devices as found in Mazzola et al., U.S. Pat. No. 5,761,750, Perry, U.S. Pat. No. 4,853,985 and Barovetto, U.S. Pat. No. 5,745,932. However, each of these prior art devices do not permit use of the hot tub when the cover is in place over the hot tub, which is a substantial disadvantage with these prior art devices. There is at least one example found in the prior art which at least attempts to address and solve the issues presented herein, that of Lutostanski, U.S. Pat. No. 5,148,646, which discloses a convertible enclosure particularly adapted to cover an outside hot tub installation which includes a tubular frame with sliding cross pieces and a cover attached to the cross pieces such that the cover may be extended to encompass one side and the top of the space desired to be enclosed with the opposite side remaining open. Lutostanski, however, provides a temporary and flimsy cover for an outdoor hot tub, one which could easily be damaged or destroyed during violent weather. Furthermore, the Lutostanski invention only provides protection including one wall and a roof, thus exposing the hot tub users to outside elements on three sides, completely defeating the intended protective function of the hot tub cover. Finally, Lutostanski discloses a convertible enclosure which must be manually installed and removed, thus necessitating the users of the hot tub to leave the comfort of the hot tub or otherwise have an associate perform the setting up or removal of the enclosure. There is therefore a need for a moveable hot tub cover structure which is rigid in nature, provides substantial protection from outdoor elements and may be quickly and easily removed or replaced from the hot tub.

Therefore, an object of the present invention is to provide an improved moveable hot tub cover structure.

Another object of the present invention is to provide a moveable hot tub cover structure which includes at least one rail structure mounted generally adjacent a hot tub and extending outwards therefrom and a rigid hot tub cover structure including at least two upright walls having bases and upper sections and a roof extending between and connecting the at least two upright walls adjacent upper sections thereof such that the roof is spaced from the bases of the upright walls to permit the hot tub cover structure to enclose the hot tub and be used with the hot tub cover structure thereon.

Another object of the present invention is to provide a moveable hot tub cover structure which further includes at least two rail-engaging wheels mounted on the hot tub cover structure, the wheels operative to rollably engage the rail structure, and a drive device such as a garage door opener-type chain drive which is operatively connected to the hot tub cover structure for rollably moving the hot tub cover structure on the rail structure between a hot tub covering position over and above the hot tub and a hot tub open position adjacent to and not covering the hot tub whereby the hot tub is useable in both the hot tub covering and open positions.

Another object of the present invention is to provide a moveable hot tub cover structure which is rigid in nature and thus provides substantial protection from outdoor elements.

Another object of the present invention is to provide a moveable hot tub cover structure which may be quickly and easily removed or replaced from the hot tub, yet allows the use of the hot tub when the cover is on the tub.

Finally, another object of the present invention is to provide a moveable hot tub cover structure which is durable in construction and safe and efficient in use.

SUMMARY OF THE INVENTION

The present invention provides a moveable hot tub cover structure for removable covering a hot tub which includes at least one rail structure mounted generally adjacent a hot tub and extending outwards therefrom and a rigid hot tub cover structure including at least two upright walls having bases and upper sections and a roof extending between and connecting the at least two upright walls adjacent upper sections thereof such that the roof is spaced from the bases of the upright walls to permit the hot tub cover structure to enclose the hot tub and be used with the hot tub cover structure thereon. At least two rail-engaging wheels are mounted on the hot tub cover structure, the wheels operative to rollably engage the rail structure, and a drive device such as a garage door opener-type chain drive is operatively connected to the hot tub cover structure for rollably moving the hot tub cover structure on the rail structure between a hot tub covering position over and above the hot tub and a hot tub open position adjacent to and not covering the hot tub whereby the hot tub is useable in both the hot tub covering and open positions.

It is thus seen that the present invention provides a substantial improvement over those inventions found in the prior art. For example, the gazebo-like structure of the present invention permits usage of the hot tub with the cover either on or off, a feature not found in the majority of covers found in the prior art. Furthermore, because the hot tub cover structure of the present invention is rigid in nature and includes at least two sidewalls and a roof, far better protection from the elements is provided by the present invention than is provided by those covers found in the prior art. Also, the fact that the hot tub cover structure of the present invention is mounted on a rail structure means that the hot tub covering structure may be quickly and easily moved to cover or expose the hot tub without requiring concentrated or extended effort to do so. Finally, the drive device connected to the hot tub cover structure permits the hot tub cover structure to be moved on or off of the hot tub quickly and easily without requiring manual manipulation of the hot tub cover structure to remove or replace the structure on the hot tub.

DESCRIPTION OF THE PREFERRED EMBODIMENT

Figure 1:
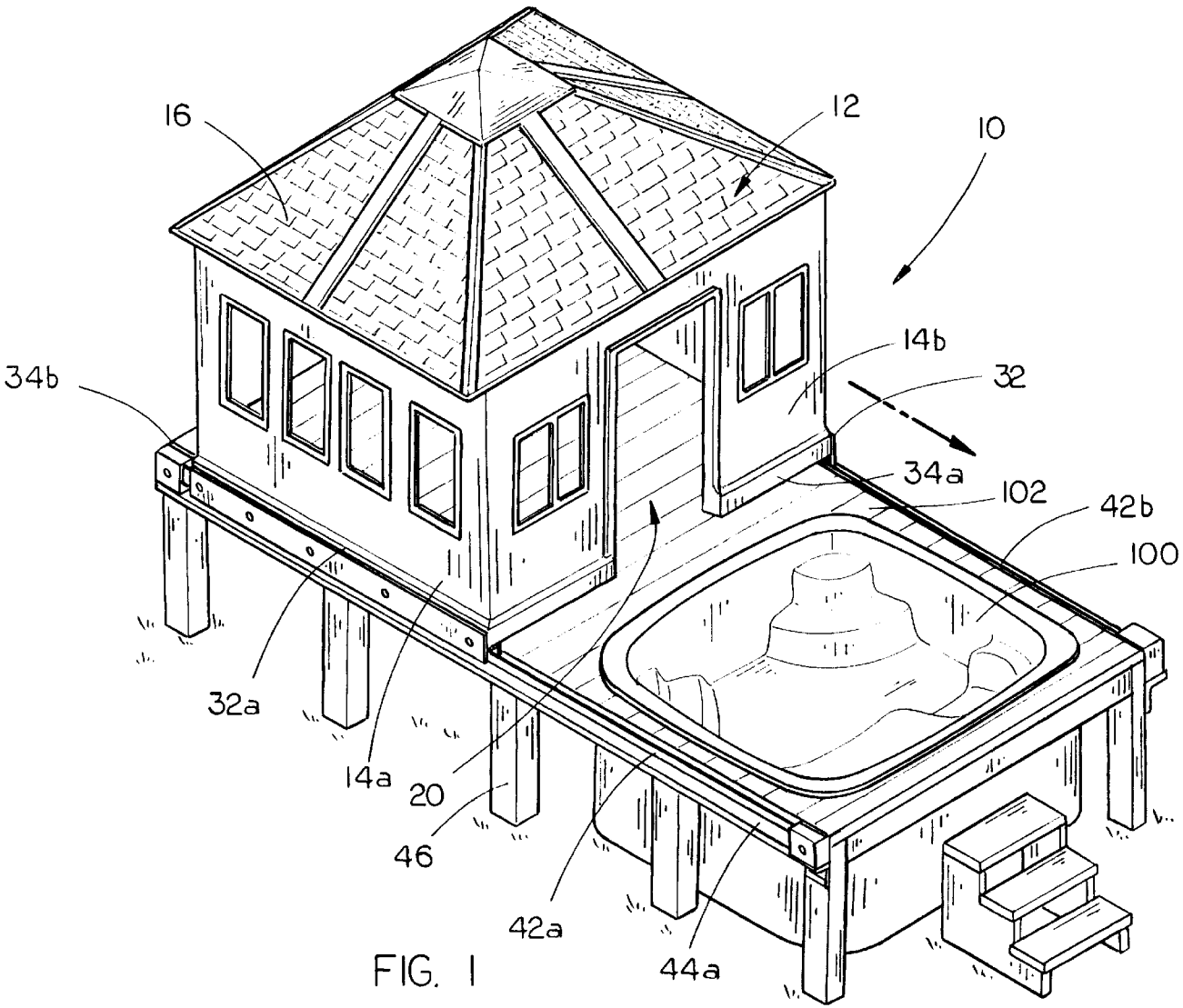
FIG. 1 is a perspective view of the present invention showing the elements thereof.

The moveable hot tub cover structure 10 of the present invention is best shown in FIGS. 1–6 as including a rigid hot tub cover structure 12 which is rollably mounted on a rail structure for covering and uncovering a hot tub 100. The hot tub cover structure 12 is shown in FIG. 1 as including four generally upright side walls 14*a*, 14*b*, 14*c*, and 14*d* (with side walls 14*c* and 14*d* not being shown in FIG. 1) on top of which is mounted a roof structure 16 thereby forming a gazebo-like enclosure. In the preferred embodiment, side walls 14*a–d* would have a height of between three to seven feet and lateral dimensions approximately equal to the lateral dimensions of the hot tub 100 with one or two additional feet in length to completely enclose and surround the hot tub 100 and the surrounding deck 102 when the hot tub cover structure 12 is placed over and above the hot tub 100. The hot tub cover structure 12 may also be constructed of wood, plastic or metal, although it is preferred that the hot tub structure 12 be constructed of a high grade wood such as cedar, redwood or another such weather-resistant wood for both aesthetic appearance and longevity. As shown best in FIGS. 2 and 3, side walls 14*a–d* would also include windows and/or doors 20 to permit access to the interior of the hot tub cover structure 12 and outward viewing from the interior of hot tub cover structure 12 thus providing protection from external elements yet permitting interaction with outside scenery. Finally, it should be noted that the hot tub cover structure 12 may be of an almost unlimited variety of sizes, shapes and designs so long as it is sturdily constructed, provides protection from external elements and is of sufficient height to allow use of the hot tub 100 when the hot tub cover structure cover 12 is in place over the hot tub 100.

The rail structure is best shown in FIGS. 1–4 as including a pair of generally parallel rails 42*a* and 42*b* mounted adjacent opposite sides of the hot tub 100 and extending rearwardly therefrom. In the preferred embodiment, rails 42*a* and 42*b* would be constructed of sections of angle iron having the ordinary V-shaped cross-sectional shape with the apex of the angle iron facing upwards, as shown best in FIG. 5. The length of rails 42*a* and 42*b* would be approximately 10 to 30 feet depending on the size of the hot tub cover structure 12 and hot tub 100, and the rails 42*a* and 42*b* would be mounted on generally parallel support beams 44*a* and 44*b* (with support beam 44*b* not being shown in FIG. 1) extending underneath rails 42*a* and 42*b* the length thereof. Support beams 44*a* and 44*b* may be mounted on the sides of hot tub 100 with support posts 46 extending downwards therefrom to contact the ground surface for supporting the support beams 44*a* and 44*b* in a generally horizontal position. The support beams 44*a* and 44*b* and support posts 46 may be constructed of various rigid materials such as angle iron or the like, although it has been found for aesthetic purposes that a high quality wood or finished metal used for construction material is preferable.

Figure 2:
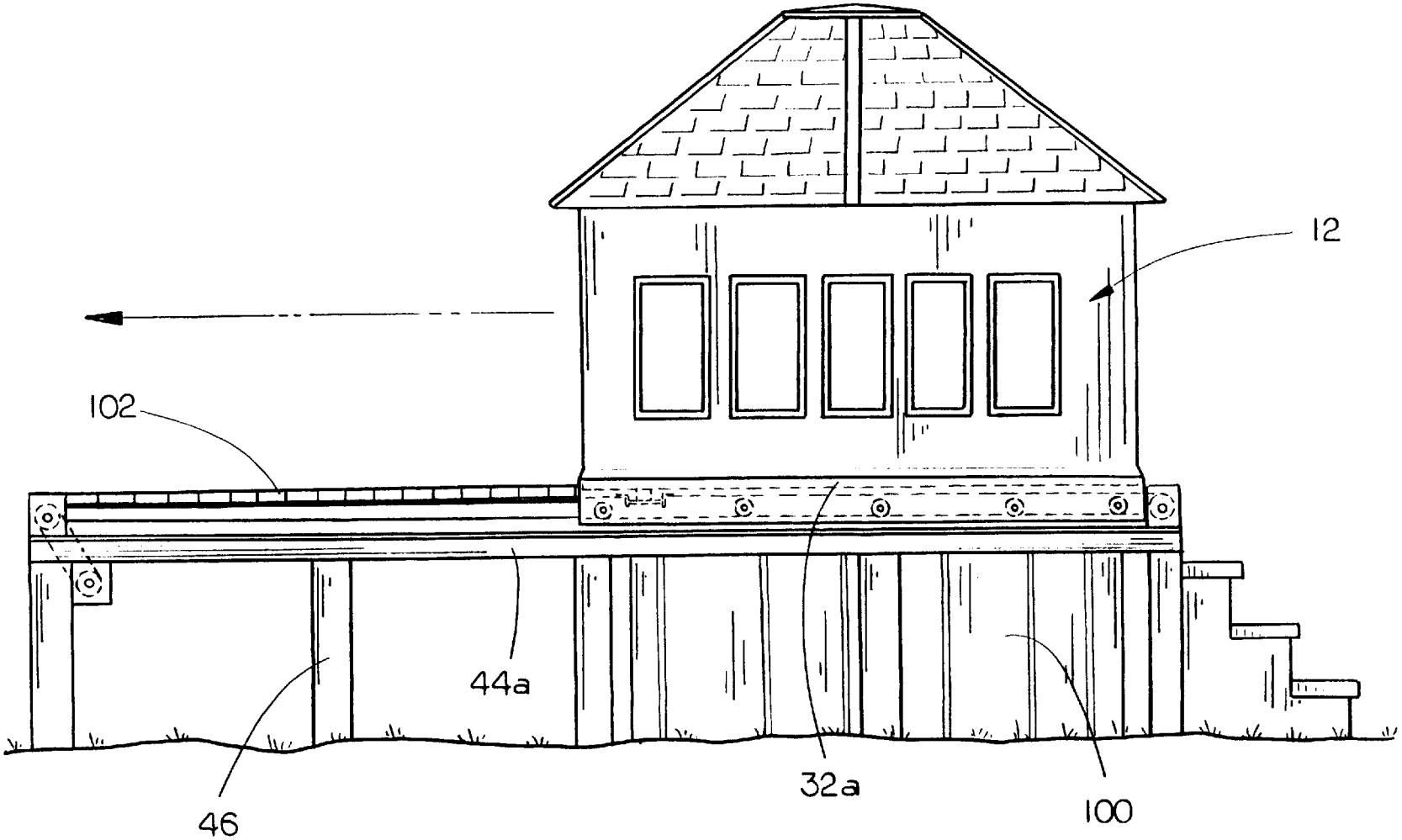
FIG. 2 is a side elevational view of the present invention.
Figure 3:
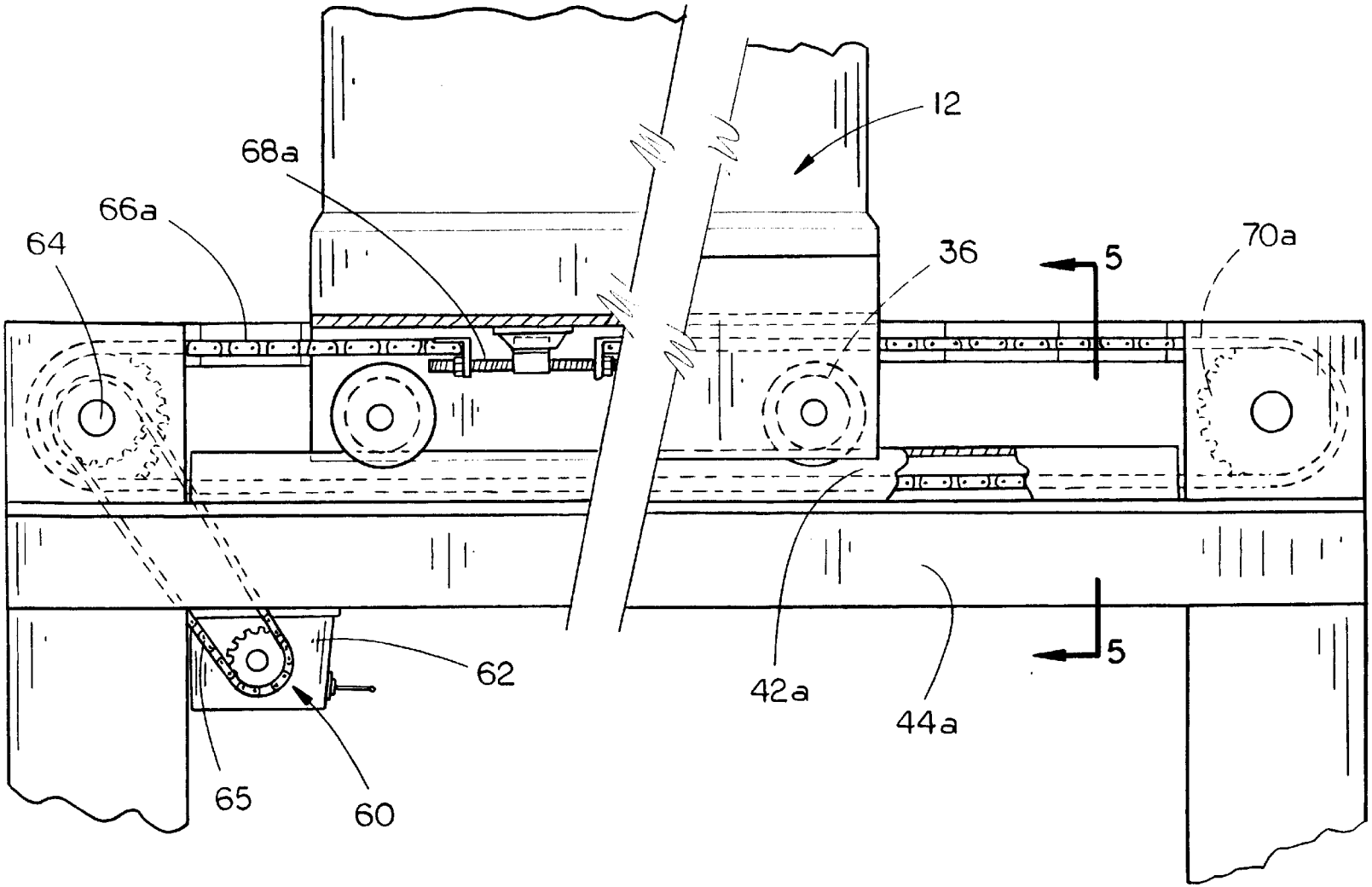
FIG. 3 is a detail side elevational view of the drive system of the present invention.
Figure 5:
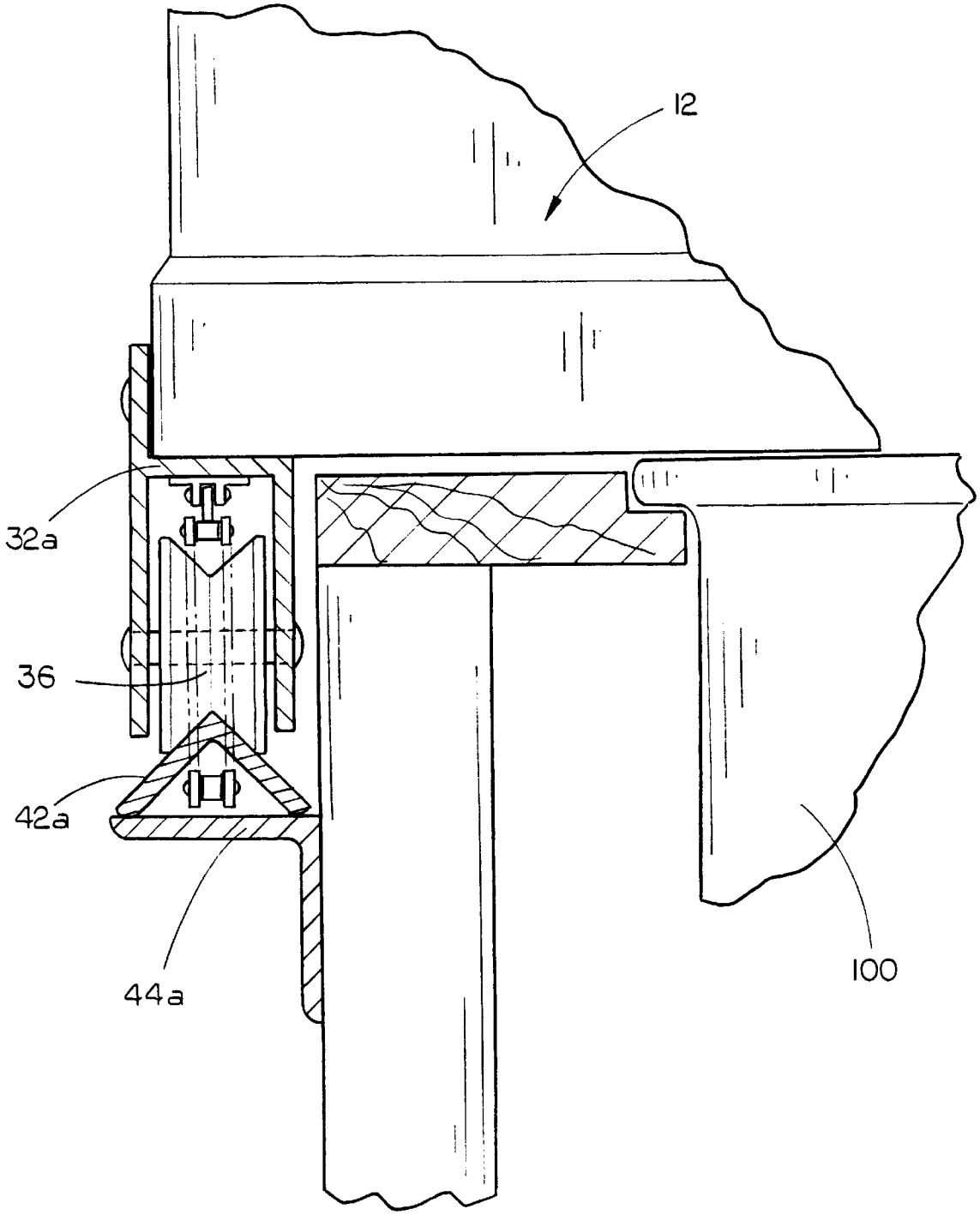
FIG. 5 is a detail end elevational view of a wheel mounted on a rail of the present invention.
Figure 6:
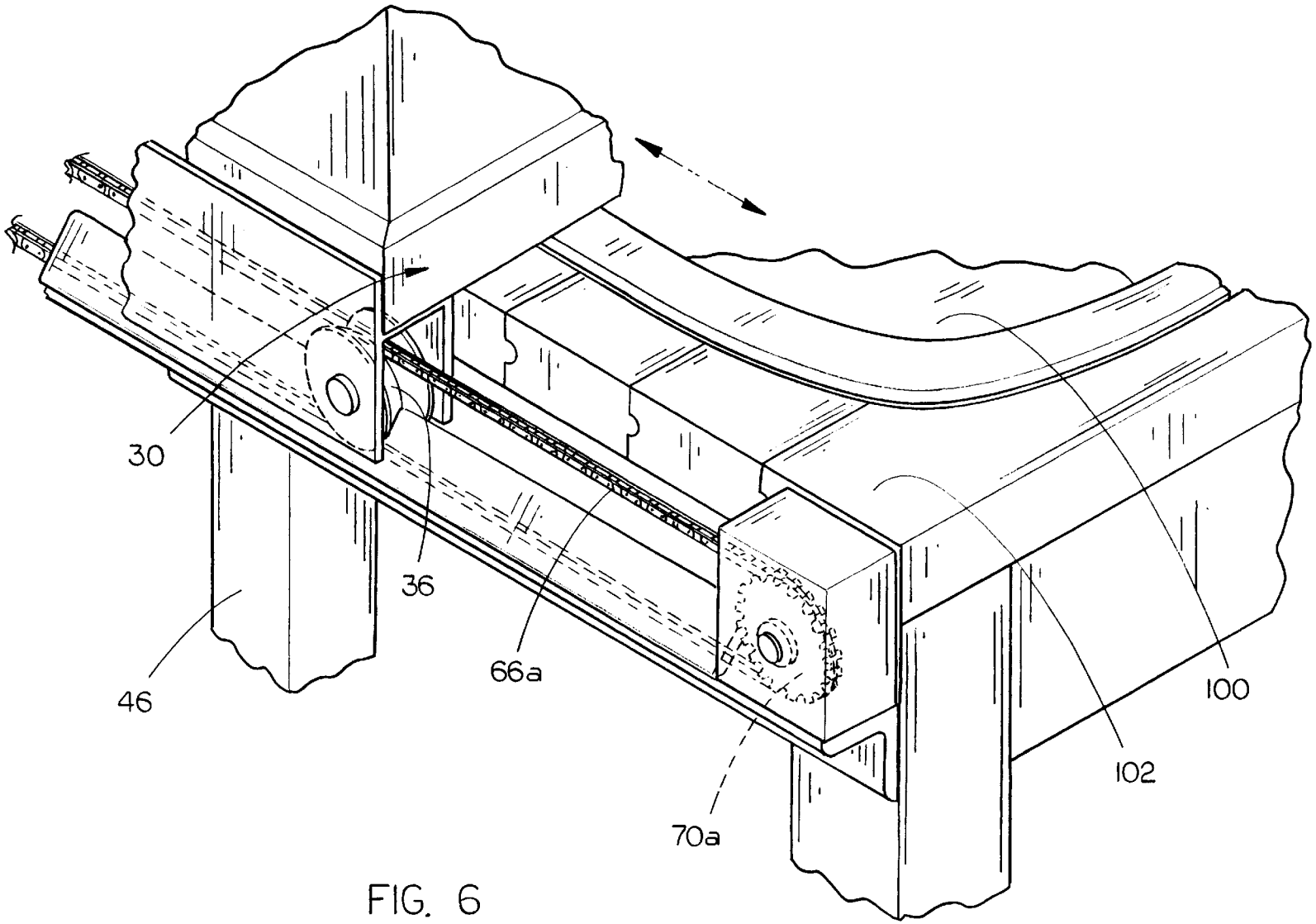
FIG. 6 is a partial detail perspective view of the wheels, rail and drive system of the present invention.

For rollably mounting the hot tub cover structure 12 on the rail structure, a wheeled cart 30 is mounted to the underside of hot tub cover structure 12 along at least two side walls 14*a* and 14*c* which are adjacent the rails 42*a* and 42*b* as shown best in FIGS. 1–3. In the preferred embodiment, wheeled cart 30 would include a square or rectangular base formed by four hot tub cover structure support beams 32*a*, 32*b*, 34*a* and 34*b* (with beams 32*b* and 34*b* not being shown in FIG. 1) which, in the preferred embodiment, would be mounted to the bases of side walls 14*a–d* of hot tub cover structure 12. Mounted to the undersides of left and right support beams 32*a* and 32*b* are a plurality of rail-engaging wheels 36 mounted in a generally horizontal plane and preferably formed of a high density plastic or rubber compound to ensure a long useful life span, each of the wheels 36 further including a circumferential V-shaped groove extending inwards towards the center of the wheel from the rim such that the V-shaped groove of each wheel 36 engages the V-shaped apex of each rail 42*a* and 42*b* thereby seating and guiding the hot tub cover structure 12 on the rails 42*a* and 42*b*, as best shown in FIG. 5. Of course, numerous variations in the size, shape and construction of the wheels 36 and rails 42*a* and 42*b* may be utilized with the present invention so long as the intended functionality of the invention is maintained. Such variations would be clear to one skilled in the art of wheel and rail interaction and manufacture. The above described arrangement thus permits the hot tub cover structure 12 to be wheelably transported along the rails 42*a* and 42*b* between a hot tub covering position, shown best in FIG. 2 and a hot tub open position, shown best in FIG. 1. However, manual transportation of the hot tub cover structure 12, while possible, is not as desirable as providing power transport of the hot tub cover structure 12 on rails 42*a* and 42*b*. To provide this power transport, a drive system 60 is mounted adjacent support beams 44*a* and 44*b* rearwards of the hot tub

Figure 4:
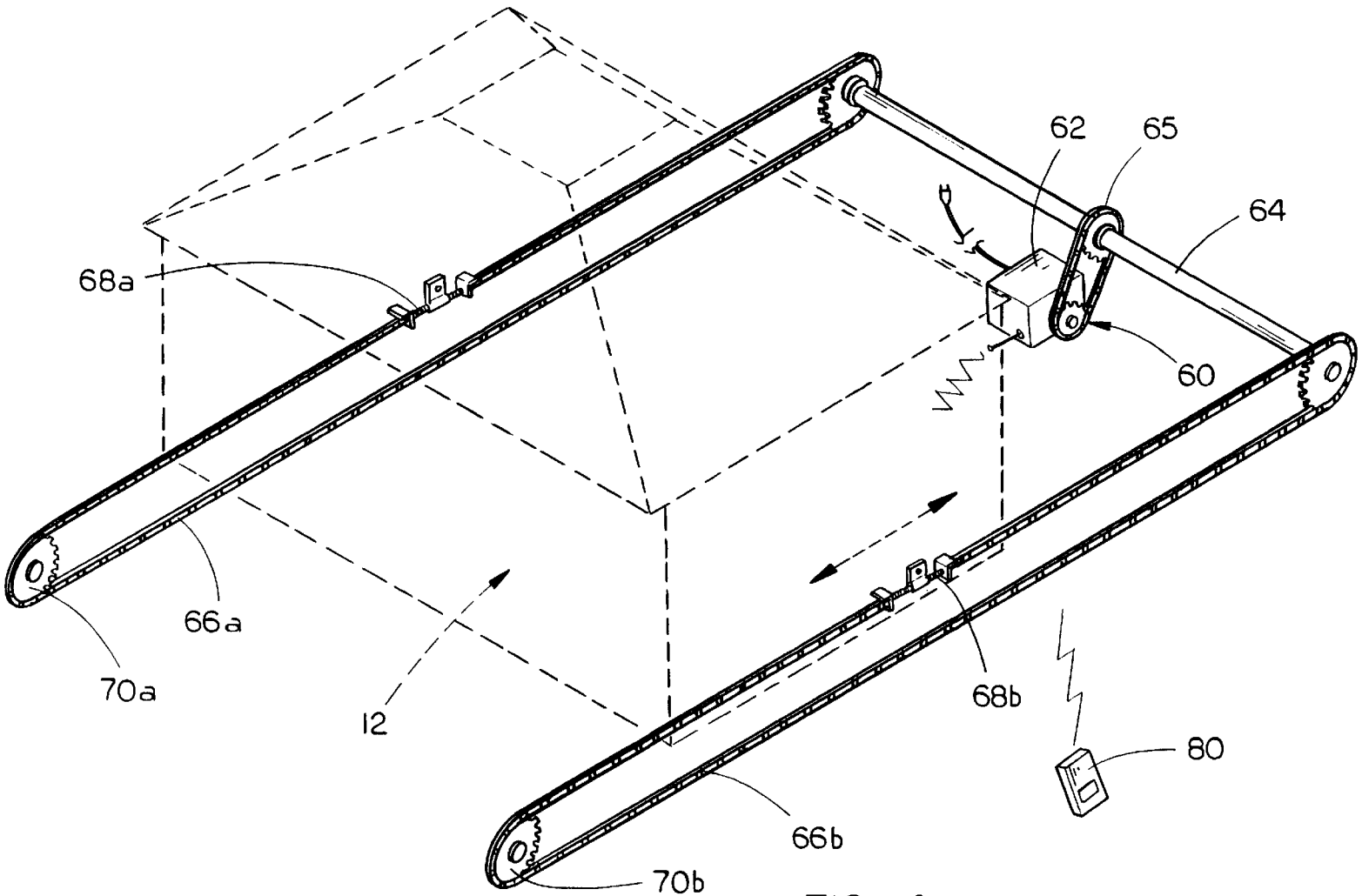
FIG. 4 is a partial detail perspective view of the drive system of the present invention.

100, the drive device operative to move the hot tub cover structure 12 between the covering position and open position. In the preferred embodiment, drive system 60 would be a garage door opener-type device such as a chain drive which would include a drive motor 62, a drive axle 64 mounted on and extending generally perpendicular to the direction of travel of the rigid hot tub cover structure at one end of the support beams 44*a* and 44*b* with a drive chain 65 extending from the drive motor 62 to the drive axle 64 and a pair of drive chains 66*a* and 66*b* extending from the drive axle 64 to a pair of pulleys 70*a* and 70*b* mounted at the opposite ends of the support beams 44*a* and 44*b*, such that rotation of the drive axle 64 rotates the drive chains 66*a* and 66*b* as shown in FIG. 4. A pair of connection bars 68*a* and 68*b* are mounted on drive chains 66*a* and 66*b* and are connected to the underside of the wheeled cart 30 as shown in FIG. 3. In this manner, as the drive chains 66*a* and 66*b* are rotated, wheeled cart 30 and thus hot tub cover structure 12 is moved along rails 42*a* and 42*b*. The drive motor 62 is reversible and, when engaged, acts to pull connection bars 68*a* and 68*b* via drive chains 66*a* and 66*b* along rails 42*a* and 42*b* or conversely push connection bars 68*a* and 68*b* away from drive motor 62 thereby rollably moving hot tub cover structure 12 along rails 42*a* and 42*b* between the open and closed hot tub cover positions. Of course, numerous types of drive systems 60 may be substituted for the above-described device, such as screw-type drives and other such propulsion devices, all of which would be understood by one skilled in the art of drive devices.

The user of the present invention may thus open or close the hot tub 100 from the safety and security of his or her dwelling without requiring the person to go out into the elements to cover the hot tub 100. As shown best in FIG. 4, a remote control device 80 could be used to activate the drive motor 62 thus engaging the drive system 60 and shuttling the hot tub cover structure 12 along rails 42*a* and 42*b* between the open and closed hot tub cover positions. Also, if an individual were to be using the hot tub 100 and inclement weather suddenly arose, the hot tub 100 could be covered by the hot tub cover structure 12 while it is still being used and use of the hot tub 100 could continue under the hot tub cover structure 12, as opposed to those covers found in the prior art. Thus it is seen that the safety, security and increased use of the hot tub 100 when fitted with the hot tub cover structure 10 of the present invention is far superior to those devices found in the prior art.

It is to be further understood that numerous modifications, additions and substitutions may be made to the moveable hot tub cover structure 10 of the present invention which fall within the intended broad scope of the appended claims. For example, the construction materials used and sizes and shapes of the particular features of the present invention may be modified and/or changed so long as the intended functionality of the present invention is not degraded or destroyed. Furthermore, although the wheels 36 and rails 42*a* and 42*b* are described as including specific features, i.e. the V-shaped grooves and V-shaped apex, various other types of rail and wheel comb-nations may be substituted which accomplish the intended purposes and are within the intended broad scope of appended claims. Finally, so long as the hot tub cover structure 12 has sufficient height to allow the hot tub 100 to be used with the hot tub cover structure 12 in place covering the hot tub 100, the exact size and shape of the hot tub cover structure 12 is not critical to the present invention and, in fact, variations in the design are expected and encouraged.

There has therefore been shown and described a moveable hot tub cover structure 10 which accomplishes at least all of its intended objectives.

I claim:

1. A movable hot tub cover structure for removably covering a hot tub comprising:

at least one rail means adapted to be mounted generally adjacent said hot tub and extending outwards therefrom;

a rigid hot tub cover structure including at least two upright side walls having bases and upper sections and a roof extending between and connecting said at least two upright side walls adjacent said upper sections thereof such that said roof is spaced from said bases of said at least two upright side walls;

at least two rail-engaging wheels mounted on said rigid hot tub cover structure, said rail-engaging wheels rollably engaging said rail means; and drive means operatively connected to said rigid hot tub cover structure, said drive means operative to rollably move said rigid hot tub cover structure on said at least one rail means between a hot tub covering position over and above said hot tub and a hot tub open position adjacent and not covering said hot tub whereby the hot tub is useable in both said hot tub covering and open positions.

2. The movable hot tub cover structure of claim 1 wherein said at least one rail means comprises at least two generally parallel rails adapted to be mounted adjacent opposite sides of said hot tub and extending rearwardly therefrom.

3. The movable hot tub cover structure of claim 2 further comprising at least four wheels mounted adjacent said bases of said at least two side walls, said wheels mounted in a generally horizontal plane, at least two of said at least four wheels mounted on said rigid hot tub cover structure in alignment with one of said at least two rails and at least two of said at least four wheels mounted on said rigid hot tub cover structure in alignment with the other of said at least two rails whereby said rigid hot tub cover structure is rollably movable on said at least two rails.

4. The movable hot tub cover structure of claim 1 wherein said rigid hot tub cover structure further comprises four upright side walls and said roof, at least one of said side walls including at least one door and at least one of said side walls including a window formed therein.

5. The movable hot tub cover structure of claim 1 wherein said drive means comprises a drive motor operatively connected to at least one chain extending along and generally adjacent to said at least one rail means, said chain connected to said rigid hot tub cover structure such that engagement of said drive motor moves said at least one chain thus moving said rigid hot tub cover structure along said at least one rail means.

6. The movable hot tub cover structure of claim 1 wherein said at least one rail means comprises two rails having a V-shaped cross-sectional shape with an apex, said rails mounted on generally parallel support beams extending underneath said rails the length thereof for supporting said rails thereon.

7. The movable hot tub cover structure of claim 6 wherein said drive means comprises a chain drive having a drive motor, a drive axle extending generally perpendicular to said rails and rotatably mounted at one end of said support beams with a drive chain extending from said drive motor to said drive axle and a pair of drive chains extending from said drive axle to a pair of pulleys rotatably mounted at the opposite ends of said support beams such that rotation of said drive axle rotates said drive chains, said drive chains further including a pair of connection bars mounted thereon, said connection bars connected to said rigid hot tub cover structure whereby reversible engagement of said drive motor alternatively pulls and pushes said connection bars via said drive chains along said rails thereby rollably moving said rigid hot tub cover structure along said rails between the open and closed hot tub cover positions.

8. In combination:

a hot tub; and a movable hot tub cover structure for removably covering said hot tub including:

at least two generally parallel rails mounted generally adjacent said hot tub and extending outwards therefrom;

a rigid hot tub cover structure including at least three upright side walls having bases and upper sections and a roof extending between and connecting said at least three upright side walls adjacent upper sections thereof such that said roof is spaced from said bases of said at least three upright side walls;

at least four wheels mounted adjacent said bases of at least two of aid at least three side walls, said wheels mounted in a generally horizontal plane, at least two of said at least four wheels mounted on said rigid hot tub cover structure in alignment with one of said at least two rails and at least two of said at least four wheels mounted on said rigid hot tub cover structure in alignment with the other of said at least two rails whereby said rigid hot tub cover structure is rollably movable on said at least two rails; and drive means operatively connected to said rigid hot tub cover structure, said drive means operative to rollably move said rigid hot tub cover structure on said at least two rails between a hot tub covering position over and above said hot tub and a hot tub open position adjacent and not covering said hot tub whereby the hot tub is useable in both said hot tub covering and open positions.

* * * * *